US007398035B2

(12) United States Patent
Zona et al.

(10) Patent No.: US 7,398,035 B2
(45) Date of Patent: Jul. 8, 2008

(54) NANOSTRUCTURE-BASED SOLID STATE CHARGING DEVICE

(75) Inventors: Michael F. Zona, Holley, NY (US); Joseph A. Swift, Ontario, NY (US); Dan A. Hays, Fairport, NY (US); John S. Facci, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 170 days.

(21) Appl. No.: 11/398,705

(22) Filed: Apr. 6, 2006

(65) Prior Publication Data

US 2007/0237547 A1 Oct. 11, 2007

(51) Int. Cl.
*G03G 15/02* (2006.01)

(52) U.S. Cl. ..... 399/168; 399/100; 399/170; 250/326

(58) Field of Classification Search ..... 399/100, 399/168, 170; 250/326
See application file for complete search history.

(56) References Cited

U.S. PATENT DOCUMENTS

| | | | | |
|---|---|---|---|---|
| 4,210,949 | A * | 7/1980 | Masuda | 361/226 |
| 7,002,609 | B2 * | 2/2006 | Lewis | 347/129 |
| 2004/0091285 | A1 * | 5/2004 | Lewis | 399/168 |
| 2005/0127351 | A1 * | 6/2005 | Tolt | 257/10 |
| 2005/0161668 | A1 * | 7/2005 | Kastalsky et al. | 257/46 |
| 2007/0235647 | A1 * | 10/2007 | Zona et al. | 250/326 |

FOREIGN PATENT DOCUMENTS

| | | | |
|---|---|---|---|
| JP | 2002279885 | * | 9/2002 |
| JP | 2006323366 | * | 11/2006 |

OTHER PUBLICATIONS

Luzinov et al., "*Adaptive and Responsive Surfaces Through Controlled Reorganization of Interfacial Polymer Layers*," Elsevier Article In Press—Prog. Polym. Sci., 2004, pp. 1-64.

* cited by examiner

*Primary Examiner*—Marvin Lateef
*Assistant Examiner*—G. M. Hyder
(74) *Attorney, Agent, or Firm*—MH2 Technology Law Group LLP

(57) ABSTRACT

Electrophotographic charging devices and methods for charging a receptor with a solid state charging device are disclosed. In an exemplary embodiment, the solid state charging device can include a dielectric layer, a first electrode disposed adjacent to a first surface of the dielectric layer, and a second electrode having a first surface disposed adjacent to a second surface of the dielectric layer. The solid state charging device can further include a plurality of nanostructures each having an end in electrical contact with a second surface of the second electrode. The exemplary solid state charging devices including the nanostructures can use less voltage than conventional charging devices, produce a reduced amount of oxidizing agents, such as, ozone and $NO_x$, and/or operate at a lower temperature.

20 Claims, 4 Drawing Sheets

NANOSTRUCTURE-BASED SOLID STATE CHARGING DEVICE

FIELD OF THE INVENTION

The subject matter of this invention relates to charging devices. More particularly, the subject matter of this invention relates to solid state charging devices coated with nanostructures for use in an electrophotographic apparatus.

BACKGROUND

In the electrophotographic process, various charging devices are needed to charge a photoreceptor ("receptor"), recharge a toner layer, charge an intermediate transfer belt for electrostatic transfer of toner, or charge a sheet of media, such as a sheet of paper. A conventional solid state charging device extracts charge, e.g., ions and/or electrons, from a high-density plasma source. The source is created by electrical gas breakdown in a high frequency AC field between two conducting electrodes, typically a coronode and one or more AC electrodes, separated by a dielectric material. The potential of the coronode, the electrode directly facing the photoreceptor, determines the polarity and magnitude of charging current. Problems arise because undesired highly reactive oxidizing species are generated in the process that degrade the photoreceptor and may cause air pollution. Moreover, in conventional solid state charging devices, charged species are generated nonuniformly across the surface of the coronode and may occur to a larger degree at the corners. To compensate, high operating temperatures are required to achieve charge uniformity. Another problem arises due to the high voltages which lead to localized breakdown of the dielectric layer that also results in non-uniform charging.

Thus, there is a need to overcome these and other problems of the prior art to provide a method and system for solid state charging of the receptor, to reduce the operating temperature and AC voltages used in the charging process, and to improve the overall operating efficiency of these devices.

SUMMARY

According to various embodiments, the present teachings include an electrophotographic charging device that can include a dielectric layer, a first electrode disposed adjacent to a first surface of the dielectric layer, and a second electrode, wherein the second electrode has a first surface disposed adjacent to a second surface of the dielectric layer. The electrophotographic charging device can further include a plurality of nanostructures, wherein each of the plurality of nanostructures has an end in electrical contact with a second surface of the second electrode.

According to various embodiments, the present teachings include a method of charging a receptor with an electrophotographic charging device. The method can include providing a solid state charging device comprising a first electrode, a second electrode, and a dielectric layer disposed between the first electrode and the second electrode, wherein the second electrode comprises a plurality of nanostructures having a first end in electrical contact with a surface of the second electrode. The method can further include applying an AC voltage between the first electrode and the second electrode. A plurality of charged species can be generated at a second end of the plurality of nanostructures and a receptor disposed opposing and spaced apart from the second electrode can be charged by depositing charged species on the receptor. A DC voltage can be applied to the second electrode, wherein the DC voltage can be approximately equal to a final receptor voltage.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

As used herein, the term "nanostructure" refers to single-walled (for example, carbon) nanotubes (SWNT), multi-walled nanotubes (MWNT), horns, spirals, as well as rods, wires, and/or fibers formed from various conductive materials. The nanostructures can have any regular or irregular cross-sectional shape including, for example, round, oval, elliptical, rectangular, square, and the like. Typically, in various embodiments individual nanostructures have a width from 1 to 500 nanometers, or from about 10 to 200 nanometers and a length of up to hundreds of microns. By controlling various parameters, such as composition, shape, length, etc., the electrical, mechanical, and thermal properties of the nanostructures can be controlled. For example, the nanostructures can be formed to be conducting or semi-conducting depending on, for example, the chirality of the nanostructures in the case of carbon nanotubes. Moreover, the nanostructures such as carbon nanotubes can have yield stresses greater than that of steel. Additionally, the carbon nanotubes can have thermal conductivities greater than that of copper, and in some cases, comparable to, or greater than that of diamond.

Figure 1:
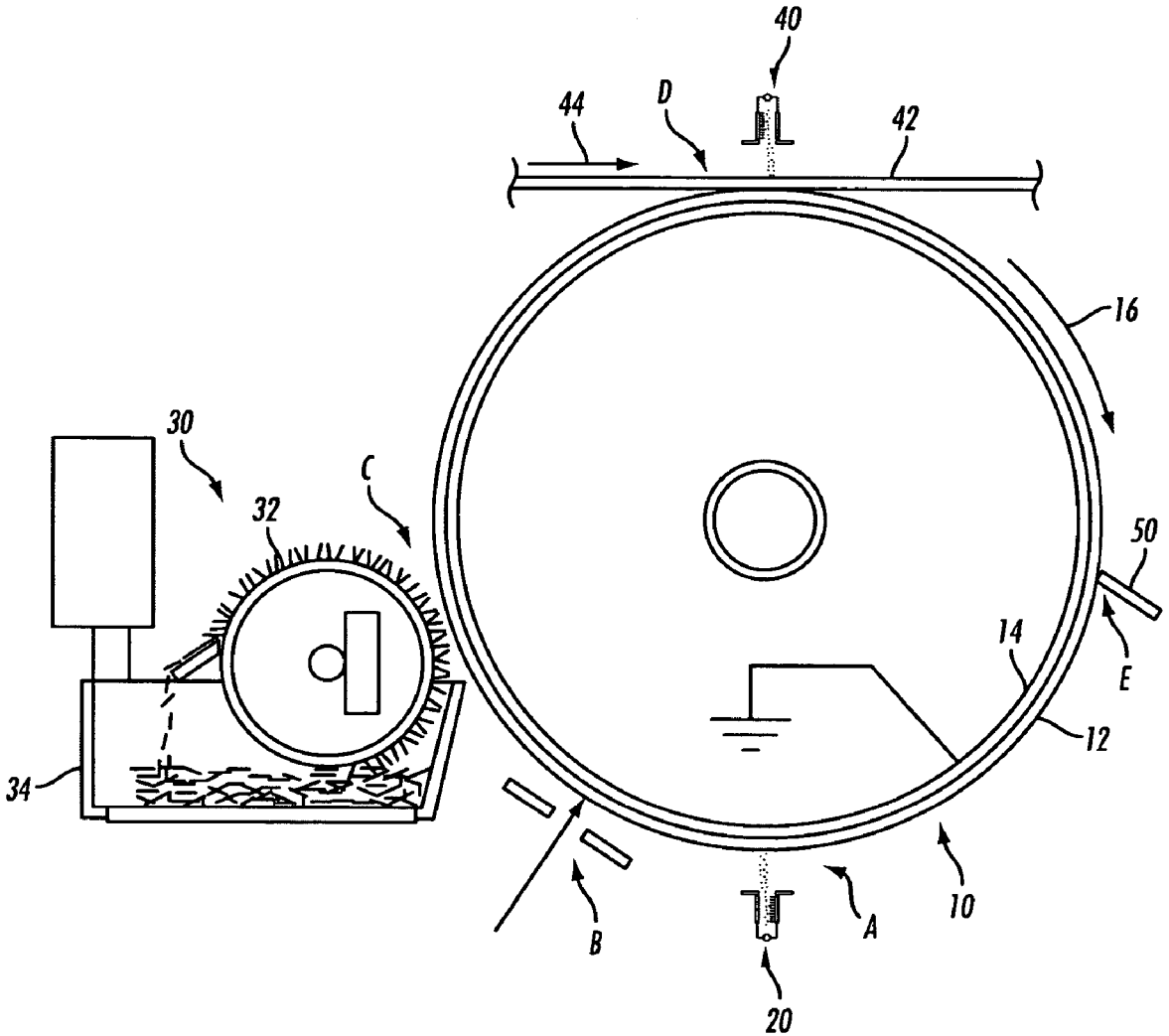
FIG. 1 is a schematic view showing an electrophotographic printing apparatus according to various embodiments of the invention.

Referring initially to FIG. 1, prior to describing the specific features of the exemplary embodiments, a schematic depiction of the various components of an exemplary electrophotographic reproduction apparatus incorporating charging devices, various embodiments of which are described in more detail below, is provided. Although the exemplary apparatus is particularly well adapted for use in an electrophotographic reproduction machine, it will be apparent from the following discussion that the present charging devices are equally well suited for use in a wide variety of electrostatographic processing machines as well as other systems that include the use of a charging device. In particular, it should be noted that the charging devices of the exemplary embodiments can also be used in the pretransfer, toner transfer, detack, erase, or cleaning subsystems of a typical electrostatographic copying or printing apparatus because such subsystems can include the use of a charging device.

The exemplary electrophotographic reproducing apparatus of FIG. 1 can include a drum with a photoconductive surface 12 deposited on an electrically grounded conductive substrate 14. A motor (not shown) can engage with drum 10 for rotating the drum 10 in the direction of arrow 16 to advance successive portions of photoconductive surface 12 through various processing stations disposed about the path of movement thereof, as will be described. Initially, a portion of drum 10 passes through charging station A. At charging station A, a charging device, indicated generally by reference numeral 20, charges the photoconductive surface 12 on drum 10.

Once charged, the photoconductive surface 12 can be advanced to imaging station B where an original document (not shown) can be exposed to a light source (also not shown) for forming a light image of the original document onto the charged portion of photoconductive surface 12 to selectively dissipate the charge thereon, thereby recording onto drum 10 an electrostatic latent image corresponding to the original document.

One of ordinary skill in the art will appreciate that various methods can be used to irradiate the charged portion of the photoconductive surface 12 for recording the latent image thereon. For example, a properly modulated scanning beam of electromagnetic radiation (e.g., a laser beam) can be used to irradiate the portion of the photoconductive surface 12.

After the electrostatic latent image is recorded on photoconductive surface 12, the drum is advanced to development station C where a development system, such as a so-called magnetic brush developer, indicated generally by the reference numeral 30, deposits developing material onto the electrostatic latent image.

The exemplary development system 30 shown in FIG. 1 includes a single development roller 32 disposed in a housing 34, in which toner particles are typically triboelectrically charged by mixing with larger, conductive carrier beads in a sump to form a developer that is loaded onto developer roller 32 that can have internal magnets to provide developer loading, transport, and development. The developer roll 32 having a layer of developer with the triboelectric charged toner particles attached thereto can rotate to the development zone whereupon the magnetic brush develops a toner image on the photoconductive surface 12. It will be understood by those of ordinary skill in the art that numerous types of development systems can be used.

Referring again to FIG. 1, after the toner particles have been deposited onto the electrostatic latent image for development, drum 10 can advance the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 can be provided for creating an electrostatic charge on the backside of support material 42 to aid in inducing the transfer of toner from the developed image on photoconductive surface 12 to the support material 42.

After image transfer to support material 42, support material 42 can be subsequently transported in the direction of arrow 44 for placement onto a conveyor (not shown) which advances the support material 42 to a fusing station (not shown) that permanently affixes the transferred image to the support material 42 thereby for a copy or print for subsequent removal of the finished copy by an operator.

According to various embodiments, after the support material 42 is separated from the photoconductive surface 12 of drum 10, some residual developing material can remain adhered to the photoconductive surface 12. Thus, a final processing station, such as cleaning station E, can be provided for removing residual toner particles from photoconductive surface 12 subsequent to separation of the support material 42 from drum 10.

Cleaning station E can include various mechanisms, such as a simple blade 50, as shown, or a rotatably mounted fibrous brush (not shown) for physical engagement with photoconductive surface 12 to remove toner particles therefrom. Cleaning station E can also include a discharge lamp (not shown) for flooding the photoconductive surface 12 with light in order to dissipate any residual electrostatic charge remaining thereon in preparation for a subsequent image cycle.

According to various embodiments, an electrostatographic reproducing apparatus may take the form of several well known devices or systems. Variations of the specific electrostatographic processing subsystems or processes described herein can be applied without affecting the operation of the present teachings.

FIGS. 2-6 depict various solid state charging devices that can be used to charge or discharge, for example, a receptor in the electrophotographic process. According to various embodiments, the exemplary charging devices described herein can include a first electrode and a second electrode separated by a dielectric material. The second electrode can include a plurality of nanostructures disposed on a surface of the second electrode, wherein each of the plurality of nanostructures has an end in electrical contact with the surface. The exemplary solid state charging devices including the nanostructures can use less voltage than conventional charging devices, produce a reduced amount of oxidizing agents, such as, ozone and $NO_x$, and/or operate at a lower temperature. The nanostructures serve to alter the intensity of the electric field for charge generation where charge generation occurs at reduced voltages. Furthermore, the generation of undesired oxidizing agents is reduced since the volume of gas required for the charge generation process is much smaller in comparison to the operation of coronodes without nanostructure coatings.

Figure 2:
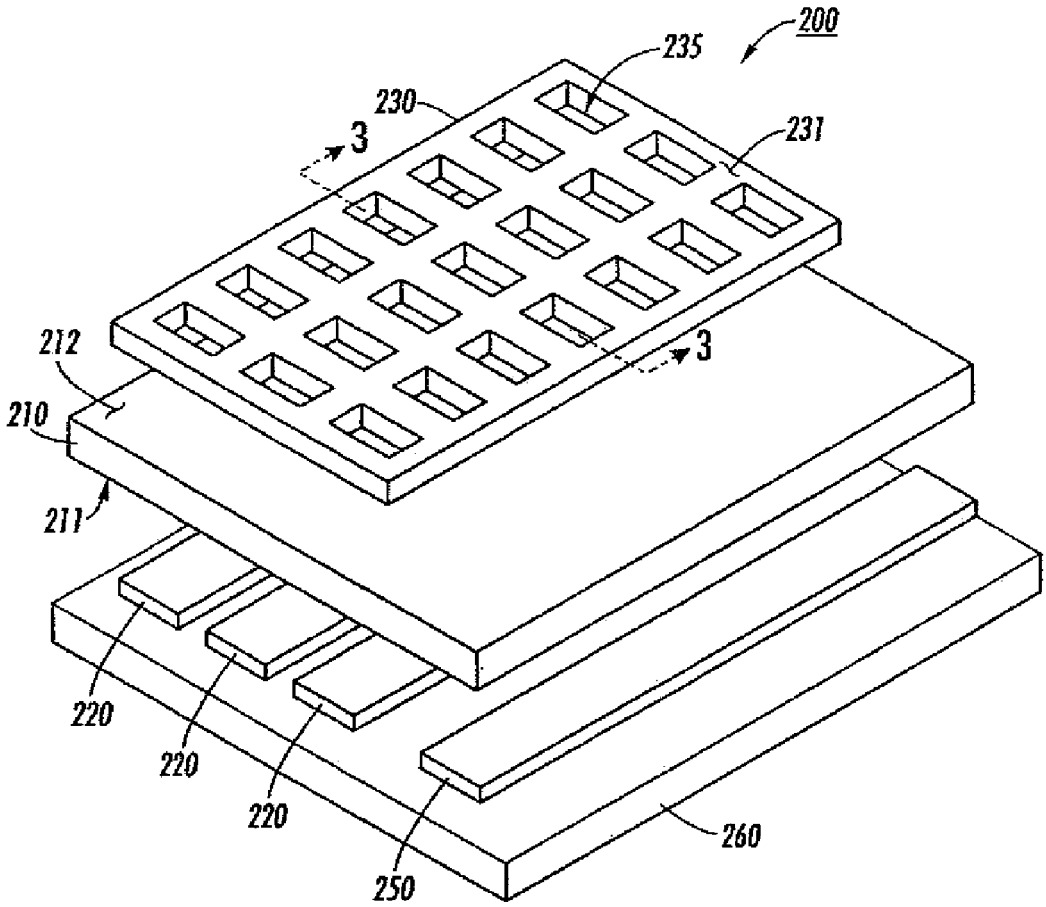
FIG. 2 depicts an exploded view of an exemplary solid state charging device including an aperture coronode with a plurality of nanostructures according to various embodiments of the invention.

FIGS. 2-6 depict various solid state charging devices that can be used to charge or discharge, for example, a receptor in the electrophotographic process. According to FIG. 2 depicts an exemplary embodiment of a solid state charging device in accordance with the present teachings. A solid state charging device 200 can include a dielectric layer 210, a first electrode 220 disposed adjacent to a first surface 211 of dielectric layer 210, and a second electrode 230 disposed adjacent to a second surface 212 of dielectric layer 210. According to various embodiments, solid state charging device 200 can further include a substrate 260, such as, for example, an alumina substrate, disposed adjacent to the first electrode. Also in certain embodiments, solid state charging device 200 can include one or more heaters 250. Referring to the partial cross sectional view of FIG. 3, second electrode 230 of solid state charging device 200 (as shown in FIG. 2) can further include a plurality of nanostructures 240 disposed such that one end of each of the plurality of nanostructures is in electrical contact with a second surface 231 of second electrode 230.

Nanostructures can be disposed over the entire surface 231 or a portion of the surface 231 of second electrode 230. Nanostructures 240 can be conductive and formed of one or more of single-walled (for example, carbon) nanotubes (SWNT), multi-walled nanotubes (MWNT), rods, wires, and fibers. Nanostructures can be formed of one or more elements from Groups IV, V, VI, VII, VIII, IB, IIB, IVA, and VA, including alloys and mixtures of these elements. Nanostructures 240 can be fabricated by a number of methods including, but not limited to, vapor deposition, vacuum metallization, electro-plating, and electroless plating. However, it will be understood by one of ordinary skill in the art that other fabrication methods can also be used. Nanostructures 240 can have a width of about 10 nm to about 500 nm. The length of nanostructures 240 can vary from about one to 200 microns. According to various embodiments, second surface 231 of second electrode 230 including nanostructures 240 can be disposed opposing and spaced apart from a receptor (not shown). In an exemplary embodiment, a gap of less than about 2 millimeters exists between the receptor and second surface 231 of second electrode 230.

Figure 3:
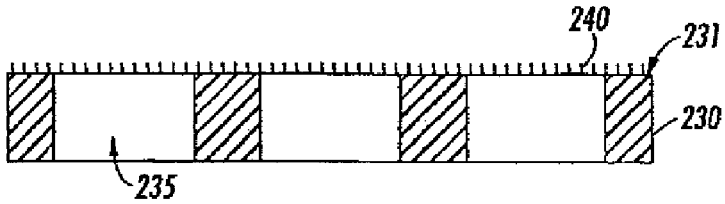
FIG. 3 depicts a cross sectional view of an aperture coronode with a plurality of nanostructures according to various embodiments of the invention.

First electrode 220 can be a plurality of AC electrodes disposed essentially parallel to each other and formed of a conductive material such as, for example, Ni and/or Au. By locating the electrode strips 220 under the aperture openings of the second electrode 230, the AC capacitance current for the AC power supply can be reduced. All of the AC electrodes 220 can be in mutual electrical contact with one another. Referring to FIGS. 2 and 3, second electrode 230 can include an array of apertures 235. According to various embodiments, array of apertures 235 can have a pitch of about 150 microns to about 200 microns, and each of the apertures of array of apertures 235 can have a width of about 50 microns to about 75 microns.

Dielectric layer 210 can serve to insulate first electrodes 220 from second electrodes 230. In various embodiments, dielectric layer 210 can have a thickness of about 25 microns or less. Dielectric layer can be formed of, for example, MgO, oxides of Al, Ta, Ti, Gd, Yb, Y, Dy, Nb La, $SrTiO_3$, $Ba_xSr_{(1-x)}TiO_3$, aluminosilicates, hafnium and zirconium silicates, mica and the like. Alternately, an insulating polymeric layer may be used made from, for example, polyimide (PI), polyether ether ether ketone (PEEK), polyurethane (PU), and the like. Referring again to FIG. 2, heater 250 can be disposed, for example, on substrate 260 parallel to first electrodes 220. In various embodiments, heater 250 can be a resistive heater having a shape and configuration known to one of ordinary skill in the art.

Figure 4:
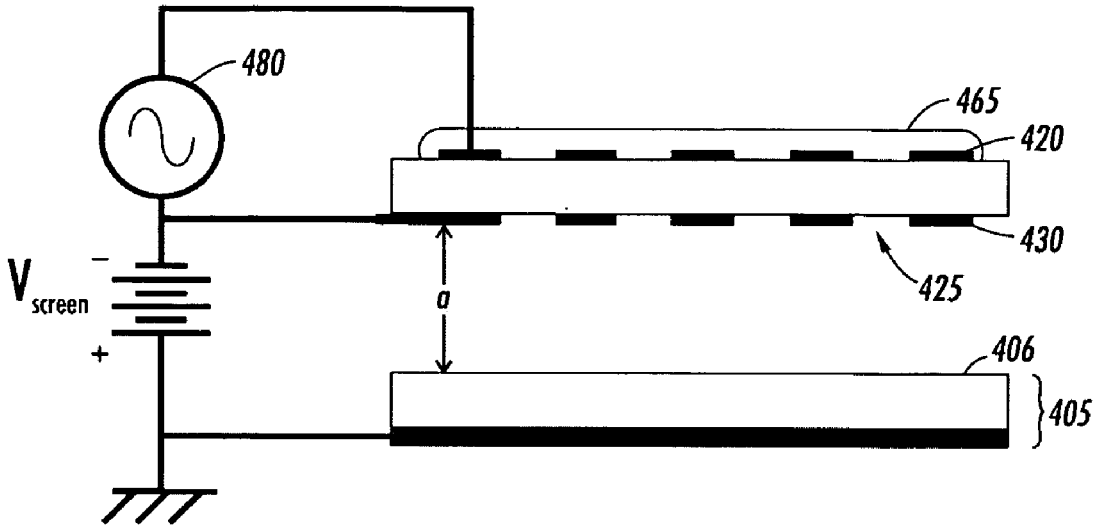
FIG. 4 depicts a cross sectional view of an exemplary solid state charging device including a coronode with a plurality of nanostructures for charging a receptor according to various embodiments of the invention.

Operation of an exemplary charging device in accordance with the present teachings is shown in FIG. 4. A high frequency AG voltage 480 can be applied between first electrode 420 and second electrode 430 by an AC power supply (not shown). According to various embodiments, the AC voltage can be up to about 2000V peak to peak with a frequency of about 20 kHz to about 1 MHz. A DC voltage shown as $V_{screen}$ approximately equal to the final receptor voltage can be applied to second electrode 430 by a DC power supply (not shown). In various embodiments, a heater, such as, for example, heater 250 in FIG. 2, can heat charging device 400 to a device temperature of about 80° C. or less. In various embodiments, an electrically insulating encapsulation layer 465 can be provided over first electrodes 420. While not intending to be limited to any particular theory, it is believed that the high frequency AC field between first electrode 420 and second electrode 430 coated with nanostructures causes the field strength at the edges of the apertures to exceed the threshold electric field for generating charged species such as electrons and/or gaseous ions. Referring back to FIG. 3, the high electric field at the tips of the nanostructures 240 at the edges of the apertures can create a positive ion, or a free electron and/or a negative ion. The charge species can collide with other gas molecules or atoms, potentially ionizing those molecules/atoms to generate additional charge species that can move to a photoconductor surface 406 as shown in FIG. 4. Photoconductor surface 406 of a receptor 405 can be disposed opposing and spaced apart from second electrode 430 on a solid state charging device 425. According to various embodiments, a gap a between photoconductor surface 406 and second electrodes 430 can be about 0.5 millimeter to about 2 millimeters. In this manner, charged species can be generated wherever the nanostructures are disposed, such as, for example, on the surface of second electrode 430 and not just at the corners.

Figure 5:
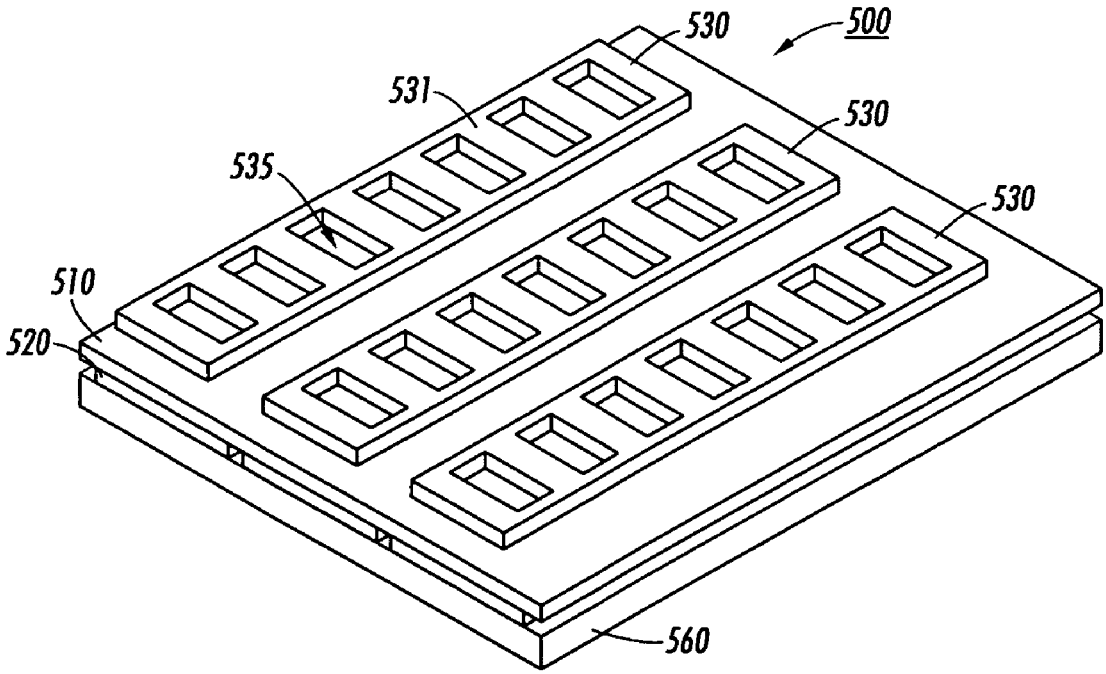
FIG. 5 depicts a perspective view of an exemplary solid state charging device including a coronode including a plurality of aperture arrays according to various embodiments of the invention.

In accordance with various other exemplary embodiments, the second electrode (coronode) with the attached nanostructures can take various forms. Referring to FIG. 5, a solid state charging device 500 can include a substrate 560, a first electrode 520 disposed adjacent to substrate 560, a dielectric layer 510 disposed adjacent to first electrode 520, and a second electrode 530 disposed adjacent to dielectric layer 510. Solid state charging device 500 can further include a plurality of nanostructures disposed on a surface 531 of second electrode 530, wherein a first end of each of the plurality of nanostructures is in electrical contact with surface 531. Second electrode 530 can include a plurality of electrodes disposed essentially parallel to each other. Each second electrode 530 can include an array of apertures 535. Although depicted as three electrodes each with an array of seven apertures, one of ordinary skill in the art will understand that this configuration is exemplary and that other configurations are contemplated.

Because the nanostructures (not shown) can be disposed on the entirety of surface 531, the slope of the current-voltage curve can be significantly increased. Further, the nanostructures can provide increased charge species generation sites for more uniform charging. As a result, exemplary solid state charging device 500 may not include a heater.

Figure 6:
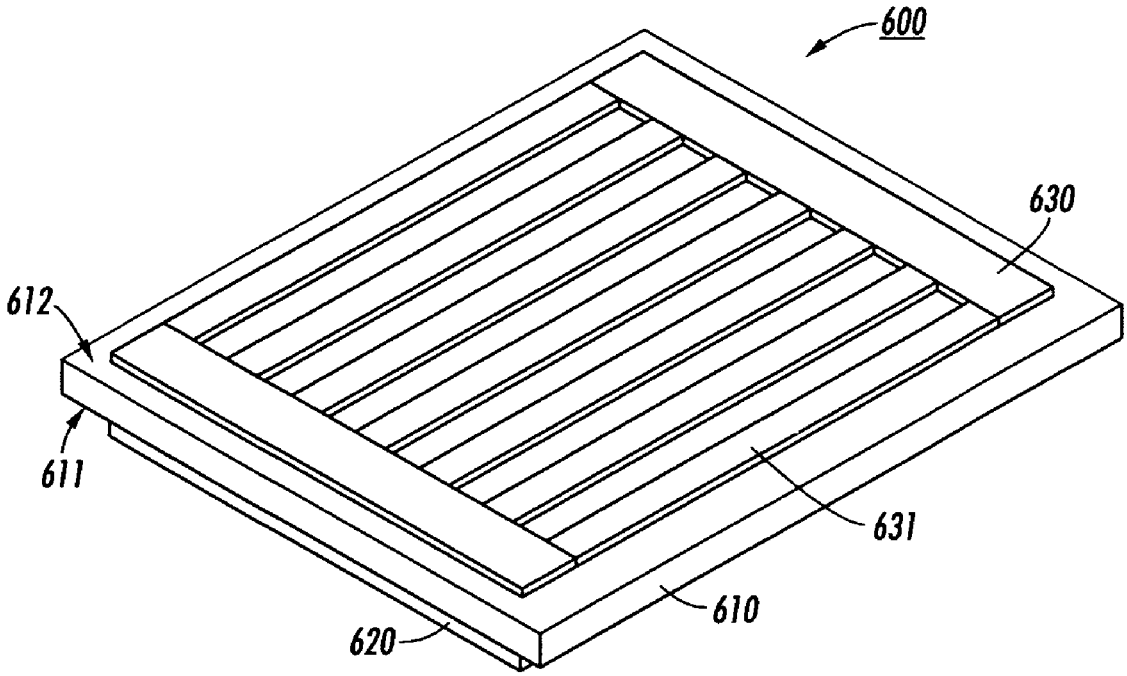
FIG. 6 depicts a perspective view of an exemplary solid state charging device including a coronode including a plurality of linear shaped electrodes according to various embodiments of the invention.

According to other embodiments, a solid state charging device can include a coronode without apertures. FIG. 6 depicts a solid state charging device 600 that can include a dielectric layer 610, a first electrode 620 disposed adjacent to a first surface 611 of dielectric layer 610, and a second electrode 630 disposed adjacent to a second surface 612 of dielectric layer 610. Solid state charging device 600 can further include a plurality of nanostructures (not shown) disposed such that one end of each of the plurality of nanostructures is in electrical contact with a second surface 631 of second electrode 630.

First electrode 620 can be either a single electrode or a plurality of parallel electrodes disposed parallel to each other. Second electrode 630 can include a plurality of parallel electrodes disposed essentially parallel to each other. Nanostructures can be disposed on all or a portion of second surface 631 of second electrode 630.

One of ordinary skill in the art will recognize that the solid state charging device configurations disclosed herein are exemplary and that other configurations can be used that include a plurality of nanostructures attached to the surface of the coronode. Further, it should be appreciated that, while disclosed systems and methods have been described in conjunction with exemplary electrophotographic and/or xerographic image forming devices, systems and methods according to this disclosure are not limited to such applications. Exemplary embodiments of systems and methods according to this disclosure can be advantageously applied to virtually any device to which charge is to be imparted.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrophotographic charging device comprising:

a dielectric layer;

a first electrode disposed adjacent to a first surface of the dielectric layer;

a second electrode, wherein the second electrode has a first surface disposed adjacent to a second surface of the dielectric layer; and a plurality of nanostructures, wherein each of the plurality of nanostructures has an end in electrical contact with a second surface of the second electrode, wherein at least one of the first electrode and the second electrode includes a plurality of electrodes disposed essentially parallel to each other.

2. The The electrophotographic charging device according to claim 1, wherein the second electrode comprises an array of apertures.

3. The electrophotographic charging device according to claim 1, wherein the plurality of nanostructures comprises one or more of single-walled nanotubes (SWNT), multi-walled nanotubes (MWNT), rods, wires, horns, spirals, and fibers.

4. The electrophotographic charging device according to claim 1, wherein the nanostuctures comprise one or more elements from Groups IV, V, VI, VII, VIII, IB, IIB, IVA, and VA.

5. The electrophotographic charging device according to claim 1, wherein the nanostuctures have a width of about 10 to about 500 nanometers.

6. The The electrophotographic charging device according to claim 1, wherein the nanostuctures have a length of about 1 to about 200 microns.

7. The electrophotographic charging device according to claim 1, further comprising a substrate disposed adjacent to a second surface of the first electrode.

8. The electrophotographic charging device according to claim 1, wherein the dielectric layer comprises MgO, the first electrode comprises Ni, and the second electrode comprises Au or Ni.

9. The electrophotographic charging device according to claim 1, further comprising an encapsulation layer disposed over the first electrode.

10. The electrophotographic charging device according to claim 1, further comprising a receptor, wherein a gap of about 0.5 millimeter to about 2 millimeters exists between the receptor and the second electrode.

11. The electrophotographic charging device according to claim 2, wherein the array of apertures has a pitch of about 50 microns to about 200 microns, and wherein each of the apertures of the array of apertures has a width of about 5 microns to about 75 microns.

12. The electrophotographic charging device according to claim 1, further comprising a heater.

13. The electrophotographic charging device according to claim 10, wherein the nanostructures are disposed at least on a surface of the second electrode that is spaced apart and opposing the receptor.

14. A method of charging a receptor with an electrophotographic charging device, the method comprising:

providing a solid state charging device comprising a first electrode, a second electrode, and a dielectric layer disposed between the first electrode and the second electrode, wherein the second electrode comprises a plurality of nanostructures having a first end in electrical contact with a surface of the second electrode;

applying an AC voltage between the first electrode and the second electrode;

generating a plurality of charged species at a second end of the plurality of nanostructures;

charging a receptor disposed opposing and spaced apart from the second electrode by depositing charged species on the receptor; and applying a DC voltage to the second electrode, wherein the DC voltage is approximately equal to a final receptor voltage.

15. The method of claim 14, wherein the step of applying an AC voltage between the first electrode and the second electrode comprises applying an AC voltage of up to about 2000 V peak to peak having a frequency of about 20 kHz to about 1 MHz.

16. The method of claim 14, further comprising heating the charging device using a heater.

17. The method of claim 14, wherein the second electrode comprises an array of apertures.

18. The method of claim 17, wherein the nanostructures are disposed on the surface of the second electrode such that generation of the plurality of charged species occurs away from edges of the apertures.

19. The method of claim 14, wherein a device temperature of the solid state charging device is less than about 80° C.

20. An electrophotographic charging device comprising:

a dielectric layer;

a first electrode disposed adjacent to a first surface of the dielectric layer;

a second electrode, wherein the second electrode has a first surface disposed adjacent to a second surface of the dielectric layer; and a plurality of nanostructures, wherein each of the plurality of nanostructures has an end in electrical contact with a second surface of the second electrode facing away from the first electrode.

* * * * *